United States Patent [19]

Kimura et al.

[11] Patent Number: 5,007,809

[45] Date of Patent: Apr. 16, 1991

[54] SCROLL COMPRESSOR WITH DIVIDING CHAMBER FOR SUCTION FLUID

[75] Inventors: Tadashi Kimura; Tetsuzo Matsugi; Yasuyuki Suzuki, all of Wakayama, Japan

[73] Assignee: Mitsubishi Denki Kabushiki Kaisha, Tokyo, Japan

[21] Appl. No.: 442,152

[22] Filed: Nov. 28, 1989

[30] Foreign Application Priority Data

Dec. 7, 1988 [JP] Japan ..... 63-310327

[51] Int. Cl.[5] ..... F04B 39/06; F04C 18/04; H02K 9/12

[52] U.S. Cl. ..... 417/371; 418/55.1; 310/59

[58] Field of Search ..... 417/366, 371; 418/55; 310/58, 59

[56] References Cited

U.S. PATENT DOCUMENTS 4,564,339 1/1986 Nakamura et al. ..... 417/366
4,702,683 10/1987 Inaba et al. ..... 418/57

FOREIGN PATENT DOCUMENTS 58-117380 7/1983 Japan .
60-32985 2/1985 Japan ..... 417/366
61-265380 11/1986 Japan ..... 417/371

*Primary Examiner*—John J. Vrablik
*Attorney, Agent, or Firm*—Oblon, Spivak, McClelland, Maier & Neustadt

[57] ABSTRACT

A scroll compressor comprises a compression mechanism comprising a combination of a fixed scroll and an orbiting scroll; a main shaft for driving the orbiting scroll; an electric motor rotor and stator for driving the shaft; a first bearing frame for supporting the orbiting scroll in the axial direction through a bearing; a second bearing frame for supporting the shaft in the radial direction through a bearing; a hermetic shell including the compression mechanism in an upper portion, the rotor and stator in a lower portion, and an suction pipe for inspiring a working fluid; and a dividing chamber arranged in the shell so as to communicate with the suction pipe and having efflux holes for directing the inspired working fluid to the compression mechanism in the upper portion, the stator and rotor in the lower portion, and an upper coil end of the stator placed in a position lateral to the chamber.

10 Claims, 5 Drawing Sheets

FIGURE

FIGURE 5a
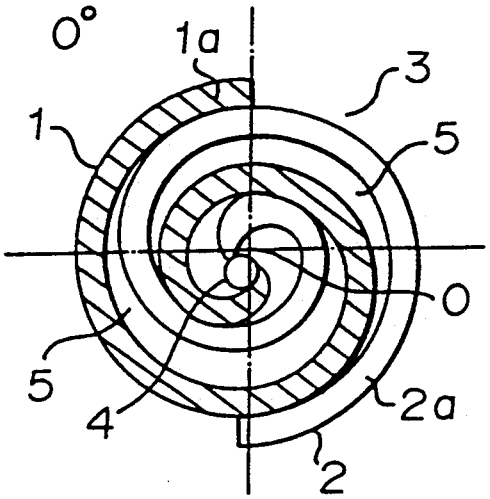
FIGURE 5d
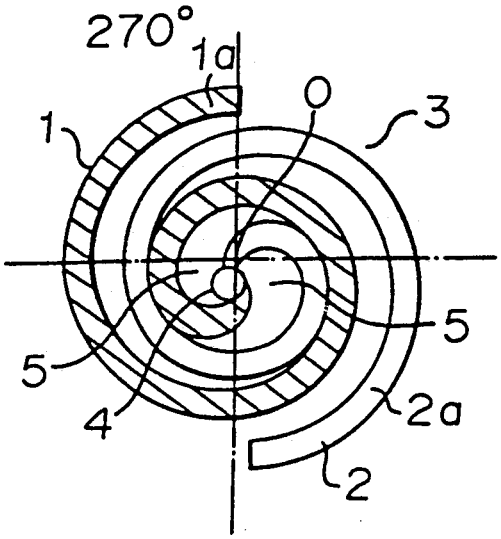
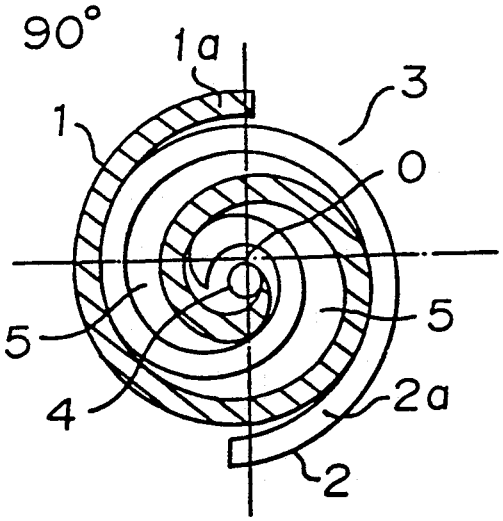
FIGURE 5b
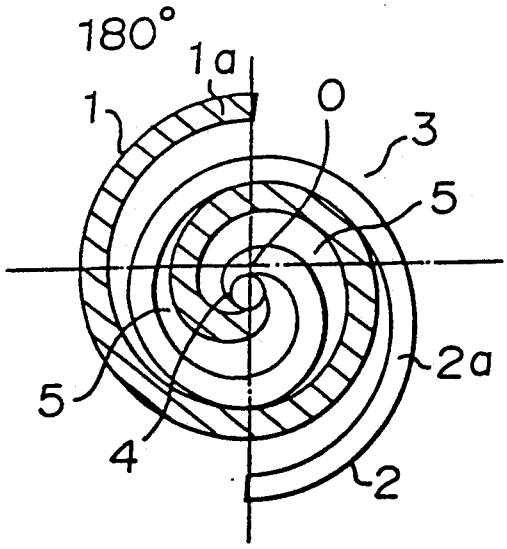
FIGURE 5c

SCROLL COMPRESSOR WITH DIVIDING CHAMBER FOR SUCTION FLUID

BACKGROUND OF THE INVENTION

The present invention relates to a scroll compressor capable of supplying a coolant gas in the least amount required to cool the motor unit.

FIGS. 5a–5d are drawings showing the operating principle of such scroll compressor. In FIGS. 5a–5d, reference numeral 1 designates a fixed scroll. Reference numeral 2 designates an orbiting scroll. Reference numeral 3 designates an suction chamber. Reference numeral 4 designates a discharge port. Reference numeral 5 designates a compression chamber. A symbol O designates the center of the fixed scroll 1.

The fixed scroll 1 and the orbiting scroll 2 have a wrap plate 1a and a wrap plate 2a, respectively, which have the same shape but whose winding direction is opposite. The wrap plates 1a and 2a are shaped to depict an involute curve, a combination of arcs or the like as is known.

Now, the operation of the fixed scroll and the orbiting scroll will be explained. The fixed scroll 1 stands still in space. The orbiting scroll 2 is combined with the stationary scroll 1 so as to be 180° out of phase with the later. The orbiting scroll revolves about the center O without rotation as shown in FIG. 5(*a*), FIG. 5(*b*), FIG. 5(*c*) and FIG. 5(*d*) corresponding to 0°, 90°, 180° and 270° of the revolution angles of the orbiting scroll, respectively.

At the revolution angle of 0° in FIG. 5(*a*), sealing the gas in the suction chamber 3 is completed, and the compression chamber 5 is formed between the wrap plates 1a and 2a. As the orbiting scroll 2 revolves, the volume of the compression chamber 5 gradually decreases to compress the gas in it. The compressed gas is eventually exhausted from the discharge port 4 which is formed at the center of the fixed scroll 1.

This is the structure outline of the device known as a scroll compressor.

Now, a specific structure and specific operation of the scroll compressor will be described in detail. FIG. 6 is an axial sectional view showing a conventional scroll compressor disclosed in Japanese Unexamined Patent Publication No. 117380/1983, wherein the scroll compressor is applied to a hermetic refrigerant compressor.

In FIG. 6, the fixed scroll 1 has the wrap plate 1a on one side of a base plate 1b. The orbiting scroll 2 has the wrap plate 2a on one side of a base plate 2b. The compressor includes the suction port (suction chamber) 3, the discharge port 4, the compression chamber 5 which is formed between both wrap plates 1a and 2a when the wrap plates 1a and 2a are combined with each other, a main shaft 6, an oil cap 7, a first bearing frame 8, and a second a bearing frame 9. The oil cap 7 has an suction port 7a, and is mounted so as to cover a lower portion of the main shaft 6, having a predetermined gap with the lower end of the main shaft 6. The first bearing frame 8 is provided with a depression 8a.

Reference numeral 10 designates a motor rotor. Reference numeral 11 designates a motor stator. Reference numeral 12 designates a shell. Reference numeral 13 designates an Oldham coupling. Reference numeral 13a designates a key which is fitted in a groove 2c formed in the orbiting scroll 2. Reference numeral 15 designates an oil reservoir which is arranged at the bottom in the shell 12. Reference numeral 16 designates a suction pipe. Reference numeral 17 designates a discharge pipe. Reference numeral 18 designates an orbiting scroll bearing which is eccentric with respect to the main shaft 6 and fixed in an eccentric hole 60a formed in an enlarged diameter portion 6a at the upper end of the shaft 6, and in which an orbiting scroll shaft 2c provided on the other side of the base plate 2b is rotatively engaged.

Reference numeral 19 designates a first main bearing for supporting the peripheral surface 61a of the enlarged diameter portion 6a at the upper end of the shaft 6. Reference numeral 20 designates a second main bearing for supporting a reduced diameter portion 6b at a lower portion of the main shaft 6. Reference numeral 21 designates a first thrust bearing for supporting the undersurface 20b of the base plate 2b with the orbiting scroll 2 in the axial direction. Reference numeral 22 designates a second thrust bearing for supporting a shoulder 6c between the enlarged diameter portion 6a and the reduced diameter portion 6b of the shaft 6 in the axial direction. Reference numeral 23 designates an oil feeding passage which is formed in the shaft 6 so as to be eccentric with respect to its axis, has an opening 23a in the lower end of the shaft 6, and communicates with the orbiting scroll bearing 18 and the second main bearing 20.

The orbiting scroll 2 has the orbiting scroll shaft 2c engaged in the main shaft 6 through the orbiting scroll bearing 18, engaging with the fixed scroll 1. The orbiting scroll 2 is supported by the orbiting scroll bearing 18 and the first thrust bearing 21 which is arranged on the first bearing frame 8.

The main shaft 6 is supported by the first main bearing 19 arranged in the first bearing frame 8, and the second main bearing and the second thrust bearing 22 which are arranged in the second bearing frame 9, both bearing frames being connected to each other in the form of socket, spigot joint or the like.

The Oldham coupling 13 is arranged between the orbiting scroll 2 and the depression 8a of the first bearing frame 8 to prevent the orbiting scroll 2 from rotating, allowing the orbiting scroll to carry out only the revolution movement.

Under such structure, the fixed scroll 1 is fastened to the bearing frames 8 and 9 by means of bolts or the like.

The motor rotor 10 and the motor stator 11 are fixed to the main shaft 6 and the bearing frame 9, respectively, by means of press fit, shrink fit, screwing or the like.

The oil cap 7 is fixed to the main shaft 6 by e.g. press fit or shrink fit.

The mechanical unit thus fabricated is housed in and fixed to the shell 12 by e.g. press fit or shrink fit with the fixed and orbiting scrolls 1 and 2 being located in an upper portion and with the motor rotor 10 and the motor stator 11 being located in a lower portion.

Now, the operation of the scroll compressor thus prepared will be explained. When the motor rotor 10 rotates, the orbiting scroll 2 starts its revolution through the main shaft 6 and the Oldham coupling 13 to commence the compression according to the operating principle as having explained with respect to FIG. 5a–5d.

At this time, a refrigerant gas is inspired in the shell 12 through the suction pipe 16, and passes through a communication hole 27 between the second bearing frame 9 and the motor stator 11, and through an air-gap between the motor rotor 10 and the motor stator 11, cooling the motor. After that, the gas passes through a communication hole 28 between the shell 12 and the bearing frames 8 and 9, and is taken through the suction port 3 formed the fixed scroll 1, into the compression chamber 5 where it is compressed. The route of the gas is indicated in arrows of solid line in FIG. 6.

The gas which has been compressed is discharged from the compressor through the discharge port 4 and the discharge pipe 17.

A lubricating oil is pumped up from the suction port 7*a* to and through the oil feeding passage 23 under the centrifugal pumping action offered by the oil cap 7 formed on and the oil feeding passage 23 formed in the main shaft 6. The oil lubricates the bearings 18–20, and arrives at the thrust bearing 21. Then the oil is returned to the oil reservoir 15 through oil returning holes 25 and 26 formed in the bearing frames 8 and 9. The route of the oil is indicated in arrows of dotted line in FIG. 6.

Since the conventional scroll compressor is constructed as described above, the air-gap of the motor is extremely narrow, lessening the amount of the gas passing through the motor unit. As a result, there is a problem in that sufficient motor cooling effect cannot be obtained. With regard to the communication hole through which the gas is passing in its total amount, there is a problem wherein when an inverter is used to give an increase in speed, the oil which has been splashed from the oil returning hole could be picked up between the peripheral surface of the stator and the inner wall of the shell, or the oil which has been deposited on the inner wall of the shell and the peripheral surface of the stator could flow back due to an increased flow rate of the gas, promoting the oil carry-over.

Regarding the latter problem, it is one solution that the distance between the peripheral surface of the stator and the inner wall of the shell is enlarged. Such solution has a disadvantage in that the outer diameter of the shell must be increased, rendering it impossible to make the compressor compact.

SUMMARY OF THE INVENTION

It is an object of the present invention to solve such problems, and to provide a compact scroll compressor capable of feeding to the motor unit a coolant gas in an amount required to cool the motor, and of minimizing the oil carry-over.

The foregoing and other objects of the present invention have been attained by providing a scroll compressor comprising a dividing chamber which is formed at a position where a suction pipe opens in the shell, and efflux holes which are formed in the dividing chamber to direct a working fluid inspired into the dividing chamber to a compression mechanism unit in an upper portion, a motor stator and a motor rotor in a lower portion, and the upper coil end of the motor stator, respectively.

In accordance with the present invention, a part of the working fluid which has been inspired into the dividing chamber is directed to the mechanism unit through the upper efflux hole, and reaches the compression chamber. Another part of the working fluid is directed to the motor stator and the motor rotor through the lower efflux hole, and cools a lower portion of the motor. In addition, the remaining part of the working fluid is directed to the upper coil ends of the motor rotor and the motor stator through the lateral efflux hole, and cools an upper portion of the motor. In this way, the working fluid is divided into three separate paths in the dividing chamber, and flows in the shell. As a result, the amount of the working fluid which is passing through the motor unit decreases, and the flow rate of the fluid between the peripheral surface of the motor stator and the inner wall of the shell decreases, reducing the amount by which a lubricating oil flowing out from an oil returning port is picked up.

BRIEF DESCRIPTION OF THE DRAWINGS

FIGS. 5(*a*) through 5(*d*) are drawings showing the compression principle of a scroll compressor.

DETAILED DESCRIPTION OF THE PREFERRED EMBODIMENT

Figure 1:
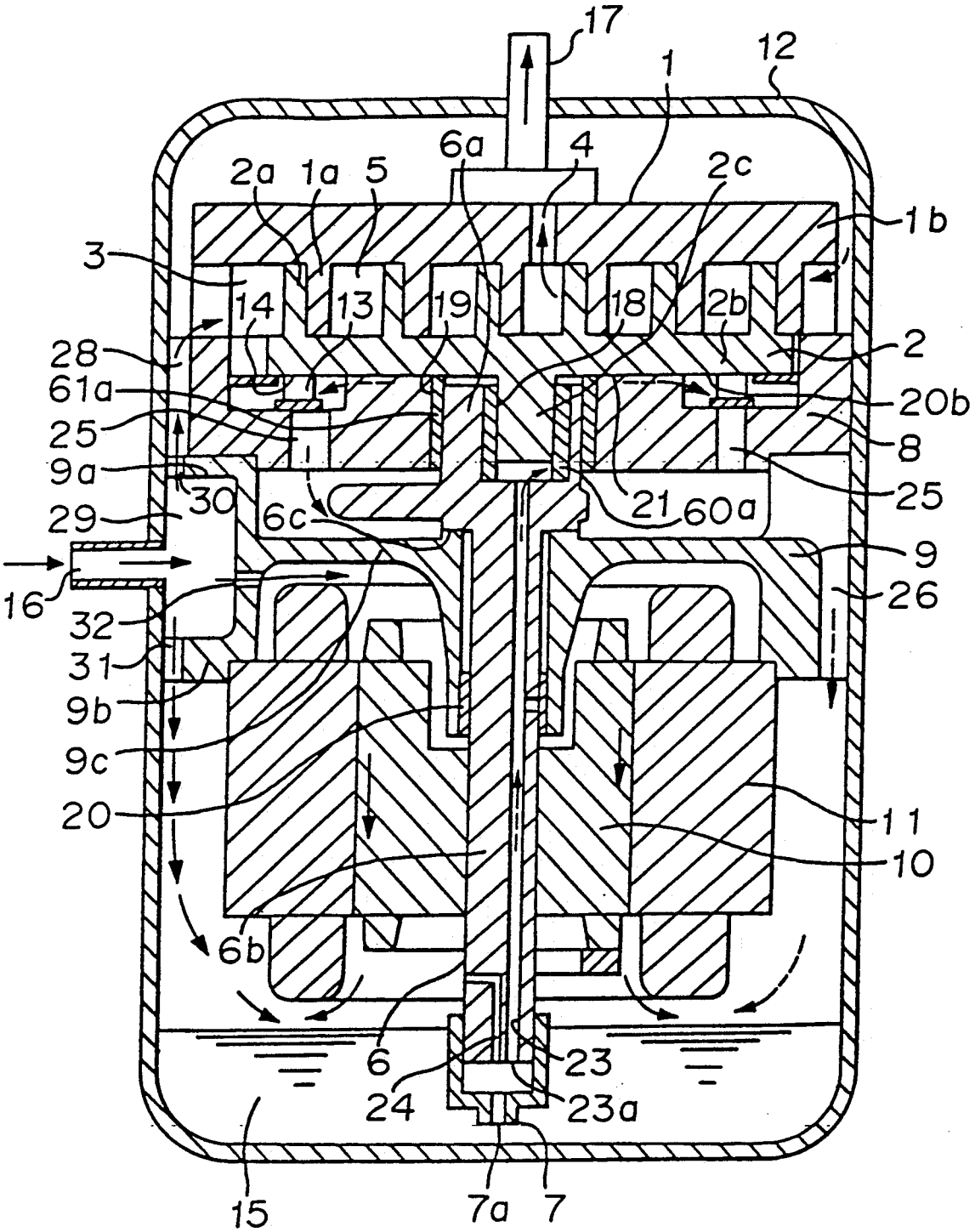
FIG. 1 is an axial sectional view of an embodiment of the scroll compressor according to the present invention.

Now, the present invention will be described in detail with reference to a preferred embodiment of the present invention illustrated in the accompanying drawings. In FIG. 1, there is shown an axial sectional view of the preferred embodiment of the scroll compressor according to the present invention, and like reference numerals designate the same parts as or parts corresponding to those shown in FIG. 6. Explanation on such parts will be omitted for the sake of clarity. Parts and structure which are different from those in FIG. 6 will be mainly described.

Figure 2:
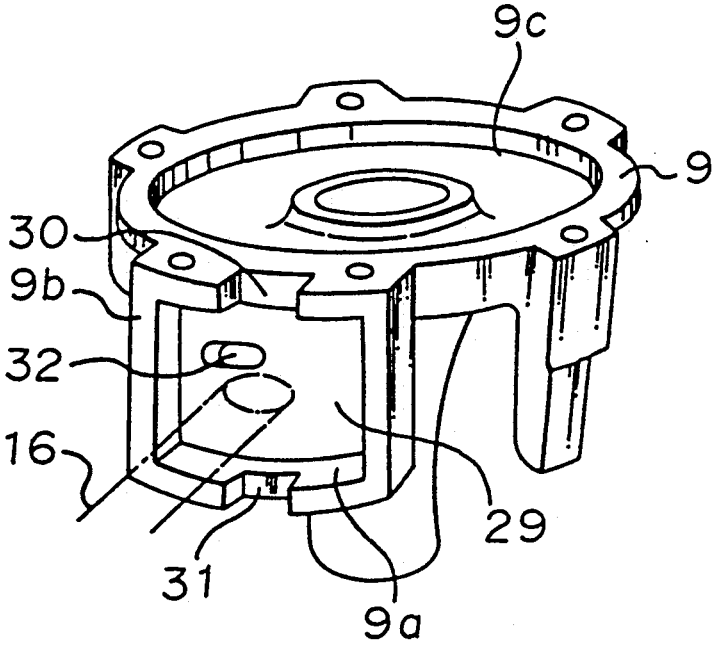
FIG. 2 is a perspective view showing the essential parts of a second bearing frame in the embodiment.
Figure 6:
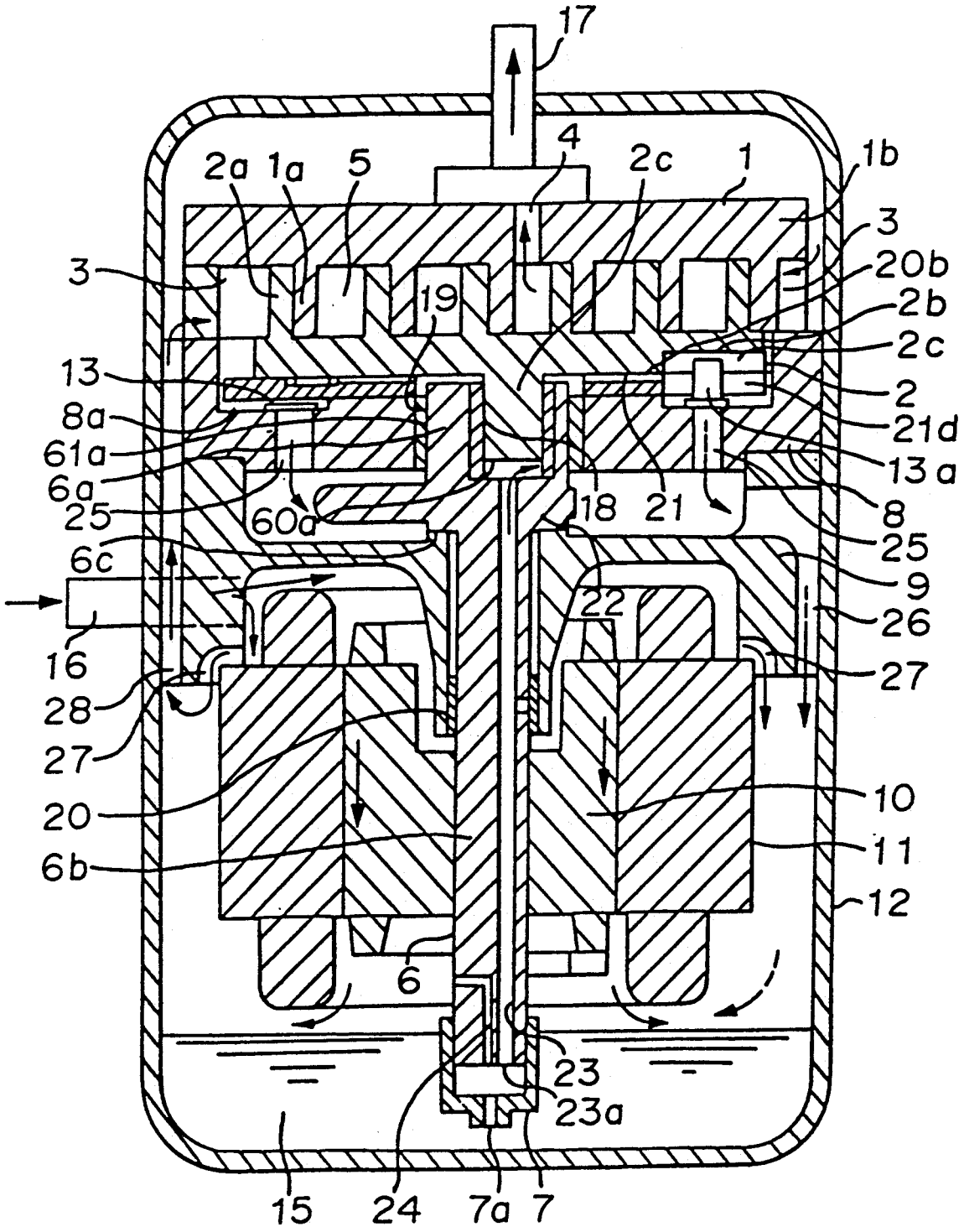
FIGURE 6 PRIOR ART
FIG. 6 is an axial sectional view of a conventional scroll compressor.

As being clear from the comparison of FIG. 1 and FIG. 2, parts indicated by reference numerals 1, 1*a*, 1*b*, 2, 2*a*–2*c*, 3–6, 6*a*–6*c*, 7, 7*a*, 8–13, 15–20, 20*b*, 21, 23, 23*a*, 24–26, 60*a*, and 61*a* are the same as those shown in FIG. 6.

The scroll compressor shown in FIG. 1 is different from that shown in the following points which are features of the embodiment.

Reference numeral 14 designates the undersurface of a base plate 2*b*. Reference numeral 9*a* designates a recess which is formed in a peripheral portion of a second bearing frame 9. Reference numeral 9*b* designates a surrounding wall which defines the recess 9*a*.

The surrounding wall 9*b* is in close contact with the inner wall of a shell 12 by press fit or shrink fit, and the inner wall of the shell and the recess 9*a* provides a dividing chamber 29. The dividing chamber 29 communicates with a suction pipe 16.

Vertically opposite parts of the surrounding wall 9*b* which defines the recess 9*a* are provided with cutouts. The upper cutout and the lower cutout form with the inner wall of the shell 12 an upper efflux hole 30 for flowing a working fluid in a first path and out of the recess, and a lower efflux hole 31 for flowing the working fluid in a second path and out of the recess, respectively.

The surrounding wall is also provided with a lateral efflux hole 32 in the direction perpendicular to the axial direction. The lateral efflux hole directs the working fluid in a third path towards a space between the top of the upper coil end of the motor stator 11 and the undersurface of a table 9c of the second bearing frame 9.

The suction pipe 16 is attached to the shell 12 so that it opens substantially at the center of the dividing chamber 29.

FIG. 2 is a perspective view showing the essential parts of the second bearing frame 9. Other parts are the same as the parts of the conventional scroll compressor, and explanation on such parts will be omitted for the sake of clarity.

Now, the efflux holes 30–32 will be described in detail. The sizes of the efflux holes 30–32 are determined so that the coil of the motor stator 11 can be equally cooled. And then the amount of picked up oil which is taken out of the inside of the compressor can be minimized.

Figure 3:
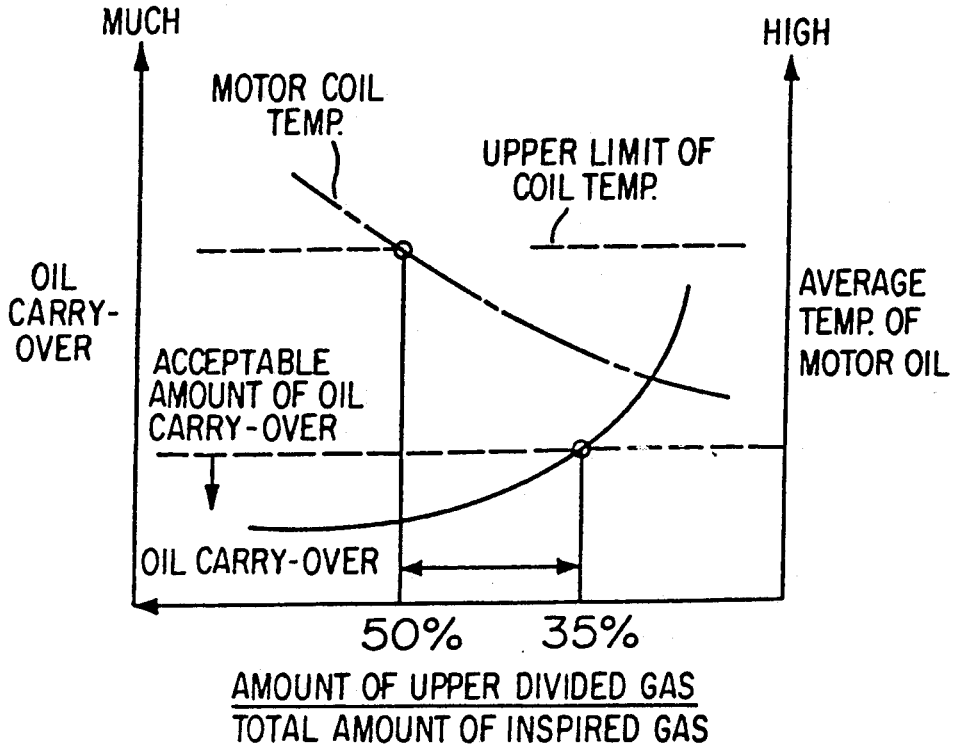
FIG. 3 is a graphical representation of characteristic curves showing the relationship between the amount of oil carry-over and average values of motor coil temperatures with respect to the ratio of the amount of a refrigerant gas flowing out of an upper efflux hole to the total amount of the gas inspired in the embodiment.

Experiments have led to the relationship, as shown in FIG. 3, between oil carry-over and average values of the motor coil temperature with respect to the ratio of the amount of the working fluid flowing out of the upper efflux hole 30 to the total amount of the working fluid inspired into the recess. The relationship shows that as the ratio of the fluid flowing out of the upper efflux hole 30 to the total amount of the fluid inspired in the recess decreases, the average temperature of the coil falls, but the oil carry-over increases.

The size of the upper efflux hole 30 is preferably set so that the ratio of the amount of the upper divided gas to the total amount of the inspired fluid is 35–50% in the range indicated by arrow in FIG. 3 in terms of the upper limit of coil temperature and the acceptable amount of oil carry-over to ensure the reliability of the coil.

Figure 4:
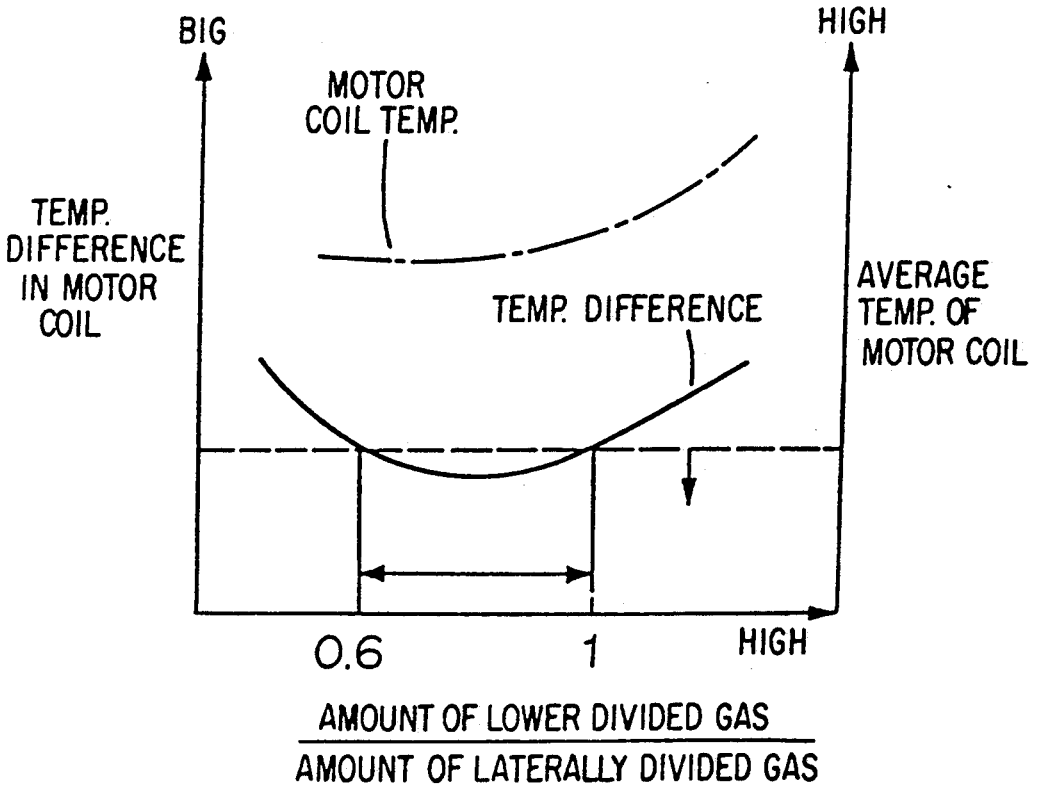
FIG. 4 is a graphical representation of characteristic curves showing the relationship between temperature differences and average temperatures of the motor coil with respect to the ratio of the amount of the gas flowing out of a lower efflux hole to the amount of the gas flowing out of a lateral efflux hole in the embodiment.

Experiments have led to the relationship of FIG. 4 between temperature differences in motor coil and average temperatures of the motor coil with respect to the ratio of the amount of the fluid flowing out of the lower efflux hole 31 to the amount of the fluid flowing out of the lateral efflux hole 32. It shows that if the amount of the fluid which flows out of the lower efflux hole 31 is too much or too small, differences in coil temperatures become large.

The sizes of the lower efflux hole 31 and the lateral efflux hole 32 are preferably set so that the ratio of the amount of the fluid flowing out of the lower efflux hole to the amount of the fluid flowing out of the lateral efflux hole is 0.6–1 in the range indicated in arrow to maintain the temperature balance of the coil.

Now, the operation of the compressor of the embodiment will be described in detail. When the motor rotor 10 starts rotating, the working fluid (herein below, referred to as the refrigerant gas) is inspired into the dividing chamber 29 from the suction pipe 16. A part of the refrigerant gas flows out of the upper efflux hole 30, goes up through a communication hole 28 in the shell 12, and is directed to the suction port 3 formed in the fixed scroll 1. Another part of the refrigerant gas flows out of the lower efflux hole 31, goes down in the vertical direction between the peripheral surface of the motor stator 11 and the inner wall of the shell 12, and cools a lower coil end of the motor stator 11 and the whole motor stator 11. After that, it rises, goes through the communication hole 28, and is directed to the suction port 3 of the fixed scroll 1. The remaining part of the refrigerant gas flows out of the lateral efflux hole 32, and cools the upper coil end of the motor stator 11. Then it joins with the gas which has flowed out of the lower efflux hole 31, and is directed to the suction port 3 of the fixed scroll 1.

Because it is insufficient to use only the refrigerant gas flowing out of the lower efflux hole 31 to cool the upper coil of the motor stator 11, the gas flowing out of the lateral efflux hole compensates for the insufficiency of cooling.

The refrigerant gas flows out of the efflux holes 30–32 into the shell 12 in a suitable proportion because the sizes of the efflux holes 30–32 are set so that the motor coil can be equally cooled.

In this way, the refrigerant gas is fed to the motor unit in only the amount required to cool it. The absolute amount of the refrigerant gas remarkably decreases in comparison with the conventional compressor, thereby lowering the speed of the refrigerant gas which is passing through the space between the peripheral surface of the motor stator 11 and the inner wall of the shell 12. As a result, it becomes difficult for the splashed oil flowed out of the oil returning hole to be picked up, and for the oil deposited on the peripheral surface of the motor stator 11 and the inner wall of the shell 12 to flow back. In this way, the oil carry-over can be minimized.

What is claimed is:

1. A scroll compressor comprising:

a compression mechanism comprising a combination of a fixed scroll and an orbiting scroll;

a main shaft for driving the orbiting scroll;

an electric motor rotor and stator for driving the shaft;

a first bearing frame for supporting the orbiting scroll in the axial direction via a bearing;

a second bearing frame for supporting the shaft in the radial direction via a bearing;

a hermetic shell including the compression mechanism in an upper portion, the rotor and stator in a lower portion, and a suction pipe for inspiring a working fluid; and means forming a dividing chamber arranged in the shell so as to communicate with the suction pipe and having efflux holes for respectively directing the inspired working fluid into three separate paths, said paths comprising a first path directed to the compression mechanism in the upper portion, a second path directed to the stator and rotor in the lower portion, and a third path directed to an upper coil end of the stator placed in a position lateral to the chamber.

2. A scroll compressor according to claim 1, wherein the dividing chamber comprises a recess formed in the peripheral portion of the second bearing frame.

3. A scroll compressor according to claim 2, wherein the recess is defined by a surrounding wall.

4. A scroll compressor according to claim 3, wherein the surrounding wall is sealingly connected to the inner wall of the shell.

5. A scroll compressor according to claim 3, wherein the efflux hole for directing the fluid to the compression mechanism comprises a notch formed in the surrounding wall adjacent the inner wall of the shell.

6. A scroll compressor according to claim 3, wherein the efflux hole for directing the fluid to the stator and rotor comprises a notch formed in the surrounding wall adjacent the inner wall of the shell.

7. A scroll compressor according to claim 3, wherein the lateral efflux hole is formed in the surrounding wall to direct the working fluid toward a space between the top portion of the upper coil end and the undersurface of the second bearing frame.

8. A scroll compressor according to claim 1, wherein the suction pipe opens at a substantially central position of the dividing chamber.

9. A scroll compressor according to claim 1, wherein the size of the efflux hole for directing the fluid to the compression mechanism is determined so that the amount of the fluid passing through the hole is 35–50% of the total amount of the fluid inspired from the suction pipe.

10. A scroll compressor according to claim 1, wherein the sizes of the efflux hole for directing the fluid to the stator and rotor, and of the efflux hole for directing the fluid to the upper coil end are determined so that the ratio of the amount of the fluid passing through the former hole to the amount of the fluid passing through the latter hole is 0.6–1.

* * * * *